United States Patent [19]

Christy

[11] 4,019,840

[45] Apr. 26, 1977

[54] POSITIVE DISPLACEMENT VANE TYPE ROTARY PUMP

[76] Inventor: Charles A. Christy, 201 Airport Drive, Farmington, N. Mex. 87401

[22] Filed: Apr. 2, 1975

[21] Appl. No.: 564,289

[52] U.S. Cl. ..... 418/241; 418/137; 418/253; 418/255

[51] Int. Cl.[2] ..... F03C 3/00

[58] Field of Search ..... 418/253, 255, 189, 137, 418/138, 241, 71

[56] References Cited

UNITED STATES PATENTS

| | | | |
|---|---|---|---|
| 560,314 | 5/1896 | Fertig | 418/241 |
| 1,417,003 | 5/1922 | Watkins | 418/138 |
| 1,736,105 | 11/1929 | Washington | 418/138 |
| 1,972,744 | 9/1934 | Lister | 418/137 |
| 2,117,573 | 5/1938 | Rawls | 418/255 |
| 2,233,269 | 2/1941 | Napolitano | 418/138 |
| 2,796,837 | 6/1957 | Hunziker | 418/255 |
| 3,213,803 | 10/1965 | Meyer | 418/255 |
| 3,322,335 | 5/1967 | Partaid | 418/138 |
| 3,834,841 | 9/1974 | Falcai et al. | 418/138 |

FOREIGN PATENTS OR APPLICATIONS

| | | | |
|---|---|---|---|
| 396,070 | 1908 | France | 418/137 |
| 662,553 | 7/1938 | Germany | 418/137 |
| 120,674 | 1/1948 | Sweden | 418/137 |

*Primary Examiner*—C. J. Husar

*Attorney, Agent, or Firm*—Karl W. Flocks

[57] ABSTRACT

Vane type rotary pumping device comprising a stationary housing member having a cavity extending therethrough, a rotor disposed in the cavity for rotation therein and having a plurality of radial openings therein, and vane members extending in each of the openings for sliding movement therein and rotary movement along with the rotor. An inlet passage and an outlet passage formed on spaced apart portions of the housing member communicate with the cavity. The cavity includes a circumferential channel extending from the inlet passage to the outlet passage to serve as a fluid pumping chamber. The vane members extend radially outwardly of the rotor and in pressure sealing relationship with the channel while being rotated through the channel by the rotor to pump fluid from the inlet passage to the outlet passage. The cavity also includes a circumferential wall portion between the outlet passage and the inlet passage over which the rotor passes with the vane members retracted within the rotor. A circumferential groove extending in the circumferential wall portion provides communication between radial openings simultaneously passing the wall portion to relieve pressure therein and to thereby facilitate radial movement of the vane members.

15 Claims, 6 Drawing Figures

POSITIVE DISPLACEMENT VANE TYPE ROTARY PUMP

BACKGROUND OF THE INVENTION

This invention relates to improvements in vane type rotary devices, particularly adapted for use as a fluid pump.

SUMMARY OF THE INVENTION

In accordance with the present invention, improvements are provided in a vane type rotary device particularly adapted for use as a fluid pump comprising the advantages of enhanced stability and high efficiency at both high and low speed operations. More particularly, in accordance with the present invention, a vane type rotary pump is provided which comprises a stationary housing having a cavity extending therethrough with an inlet passage, an outlet passage, a circumferentially extending channel portion forming a fluid pumping chamber between the inlet and outlet passages, and a vane-rotor assembly rotatably supported in the cavity of the housing for effecting pumping action. The vane-rotor assembly includes a rotor member which is adapted to rotate about an axis coaxial with the cavity. The channel forming the pumping channel extends radially outwardly of the path traversed by the rotor. To effect pumping action the rotor is formed with a plurality of radial openings in which are disposed a plurality of vanes adapted to slide therein and rotate therewith. The sliding vanes are pivotally supported on a journal parallel to, but eccentric to the axis of the rotor so that rotation of the rotor induces radial movement of the vanes in the respective openings in the rotor. The eccentricity between the axis of the journal pivotally supporting the vanes and the axis of the rotor is arranged so that the vanes are moved out of their openings into sealing contact with the channel of the pump housing cavity to effect positive pumping action.

Over the idle or non-pumping movement of the rotor the vanes are radially retracted within their respective openings by reason of the eccentricity between the axes of the journal and of the rotor. In this connection, the vanes must retract into their respective openings upon passing the outlet passage, and further retraction of the vanes ordinarily would in effect result in the drawing of a vacuum, which would be very difficult, if not impossible. To offset this difficulty or impossibility, a pressure relief groove is provided in the cavity in the area where the vanes are not pumping to provide communication between rotor openings simultaneously passing thereover, so that any fluid trapped in these openings may freely move therebetween particularly where one vane is moving radially inwardly and another vane is moving radially outwardly.

BRIEF DESCRIPTION OF THE DRAWINGS

For better understanding of the present invention, reference may be made to the accompanying drawings in which.

DETAILED DESCRIPTION OF THE PREFERRED EMBODIMENTS

Figure 1:
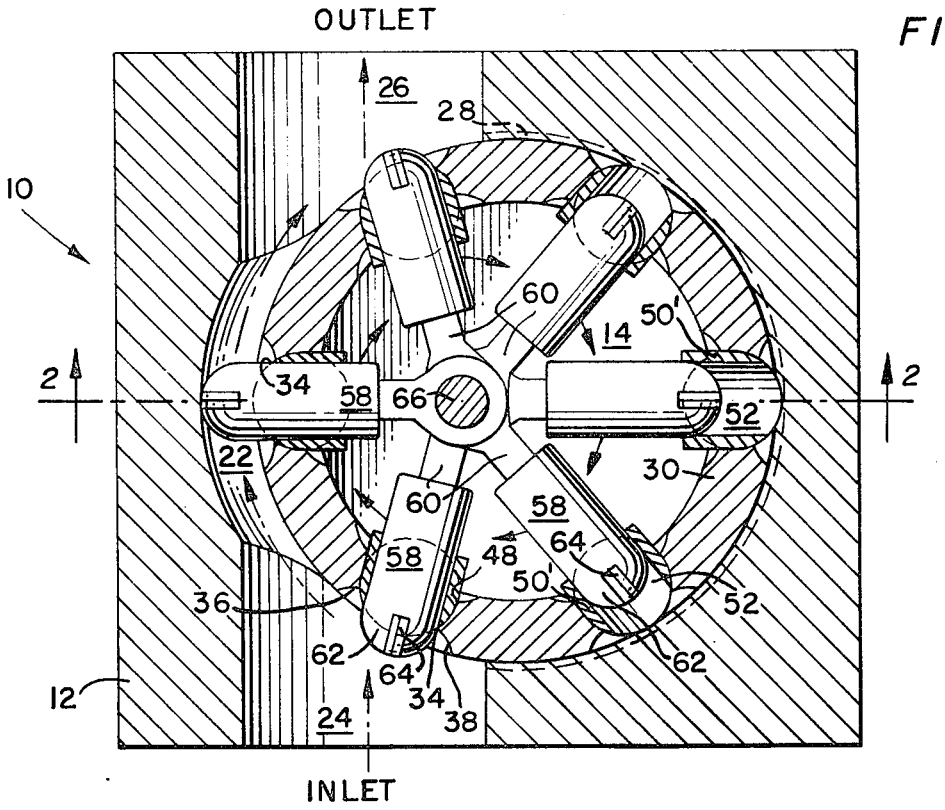
FIG. 1 represents a plan view of the preferred embodiment of the present invention in section taken along the line 1—1 and looking in the direction of the arrows in FIG. 2.
Figure 2:
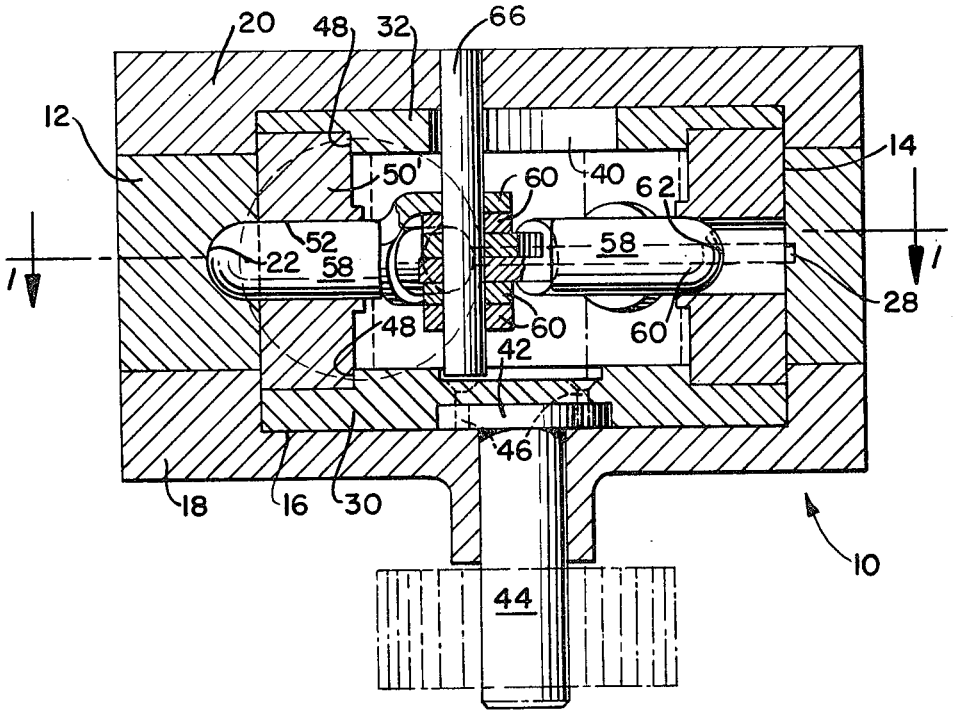
FIG. 2 is an elevational view taken along the line 2—2 and looking in the direction of the arrows in FIG. 1.
Figure 3:
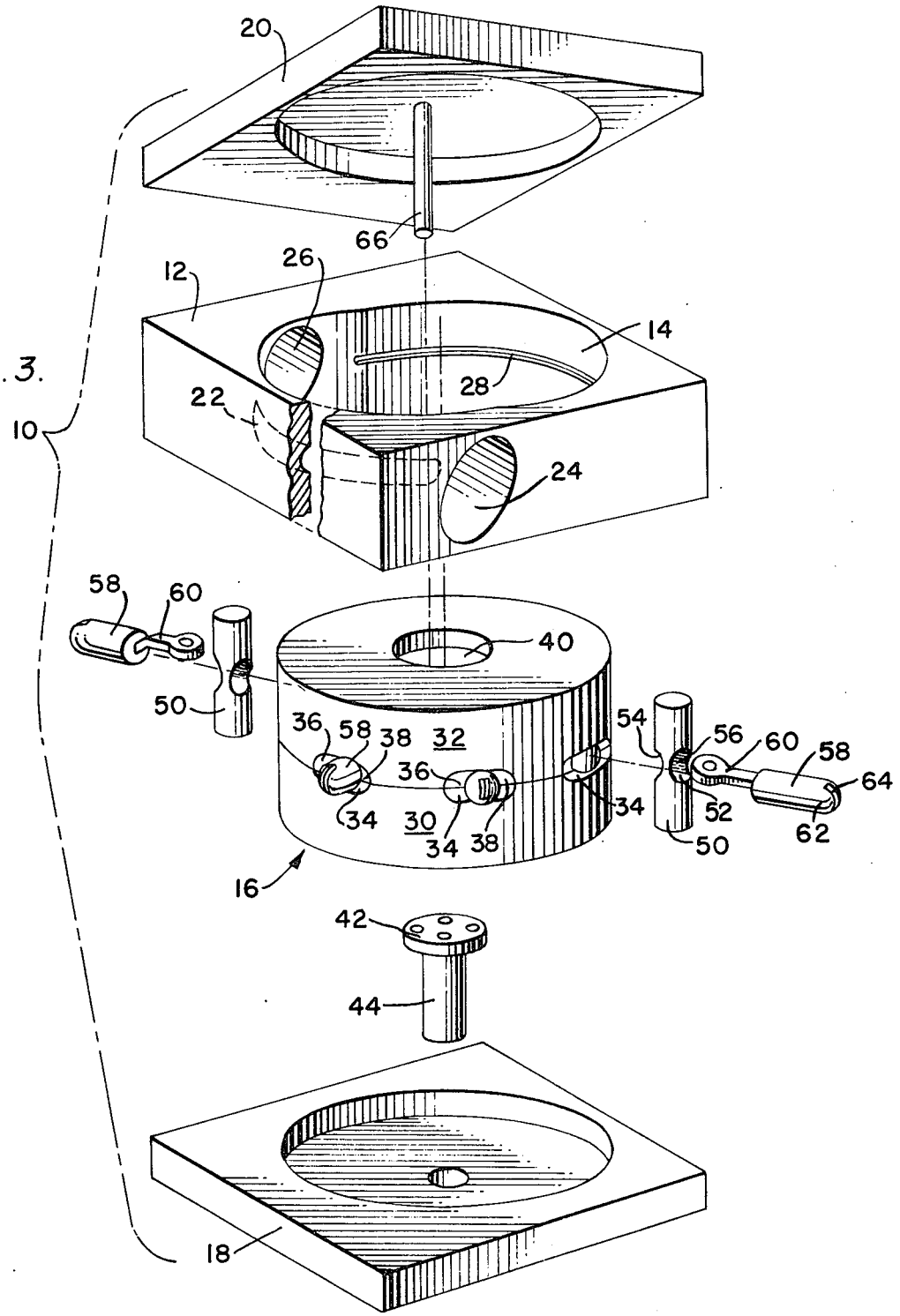
FIG. 3 is an exploded view in perspective of the embodiment of FIGS. 1 and 2 including pins of an alternate form.

Looking now in detail at FIGS. 1–3, it is seen that the preferred embodiment of the vane rotary device 10 according to the present invention comprises a housing member 12 with a cavity 14 extending therethrough, a rotor 16 disposed in the cavity 14 and end closure members 18, 20. Cavity 14 is generally cylindrical, but includes a toroidal channel 22 offset radially beyond the outline of the major portion thereof which is cylindrical. Housing member 12 is also formed with an inlet passage 24 which communicates with channel 22 at one side thereof and an outlet passage 26 which communicates with the other side thereof. Cavity 14 is further provided with a circumferentially extending groove 28, as clearly seen in FIG. 3, the function of which will be further described hereinbelow. Rotor 16, which may for convenience be made in two separate parts 30, 32, comprises a plurality of radial openings 34 with circumferential recesses 36, 38 on opposite sides thereof. Also, for convenience, rotor 16 may be generally cylindrical in shape and provided with an enlarged aperture 40 in the part 32, as seen in FIGS. 2 and 3. Rotor 16, as seen in FIG. 2, is rigidly connected to the flange 42 of drive shaft 44 by screws 46 passing through part 30 thereof. Rotor 16 is formed with cylindrical socket portions 48 to rotatably support cylindrical pins 50 which, as may be visualized in FIG. 3, extends axially therein and allow oscillation thereof. Pins 50 are provided with radial openings 52 having notched portions 54, 56 on opposite sides thereof. In an alternative form the pin 50 may take the form of pin 50' which, as may be seen in FIGS. 1 and 2, includes radially inwardly projecting skirt portions. Each radial opening 52 accommodates a generally cylindrical plunger 58 in sliding relationship therein and constrained to rotate along with rotor 16. Each plunger 58 includes a radially inwardly connecting link 60 and a radially outer dome-shaped end 62 with a sealing member 64 thereon. Connecting link 60 of each plunger 58, as seen in FIG. 2, is axially offset from each other and pivotally connected to journal element 66 extending inwardly from end to closure member 20 in cantilever fashion. Journal element 66 further extends parallel to but eccentrically of drive shaft 44 and through and clear of enlarged aperture 40. Toroidal channel 22 in cross section conforms to the shape of sealing member 64 and is laid out with a radius having its center coincident with the axis of journal element 66.

In operation of the vane rotary device 10, power transmission means shown in outline form on the end of drive shaft 44 effects rotation of rotor 16 whereby plungers 58 are caused to move past inlet passage 24 and through channel 22 which forms a pumping chamber to pump fluid to outlet passage 26. In thus being driven clockwise, as indicated by the arrows in FIG. 1, plungers 58 are caused to slide outwardly of radial openings 52 in pins 50' and radial openings 34 of rotor 16 by reason that journal element 66 is eccentric to drive shaft 44 in the direction toward channel 22 whereby the sealing members 64 are constrained to engage channel 22 in sealing relationship therewith. After the plungers 58 pass the outlet passage 26, they are retracted radially inwardly of rotor 16 and in so being retracted difficulty may be expected to be encountered due to the virtual impossibility to draw a vacuum. To offset this difficulty circumferential groove 28 permits communication between radial openings 34 simultaneously moving through an idle phase of the operation so that pressure whether negative or positive in these openings 34 may be relieved therebetween. Also, any tendency of plungers to oscillate in the vicinity of openings 52 is accommodated by notched portions 54, 56.

Figure 4:
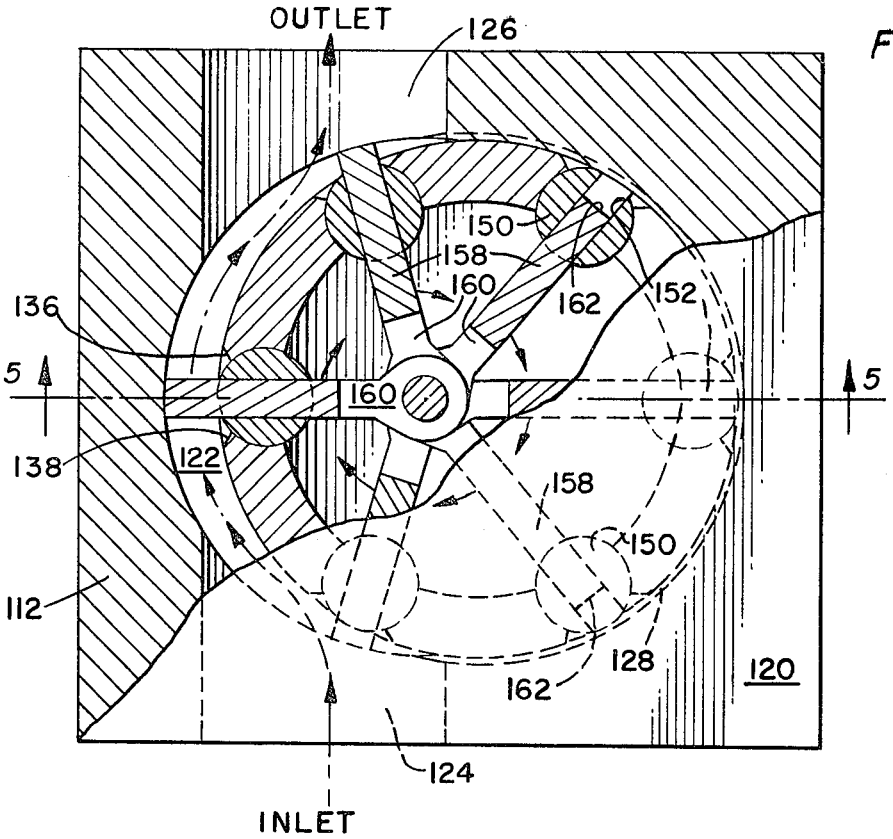
FIG. 4 represents an elevational view of an alternative embodiment of the present invention in section taken along the line 4—4 and looking in the direction of the arrows in FIG. 5.
Figure 5:
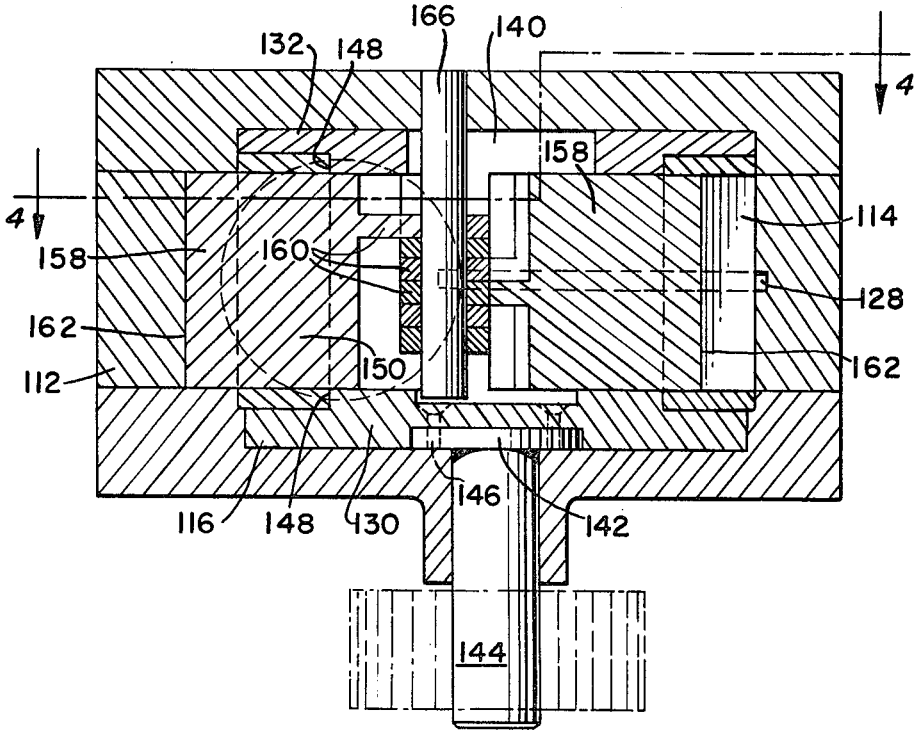
FIG. 5 is an elevational view in section taken along the line 5—5 and looking in the direction of the arrows in FIG. 4.
Figure 6:
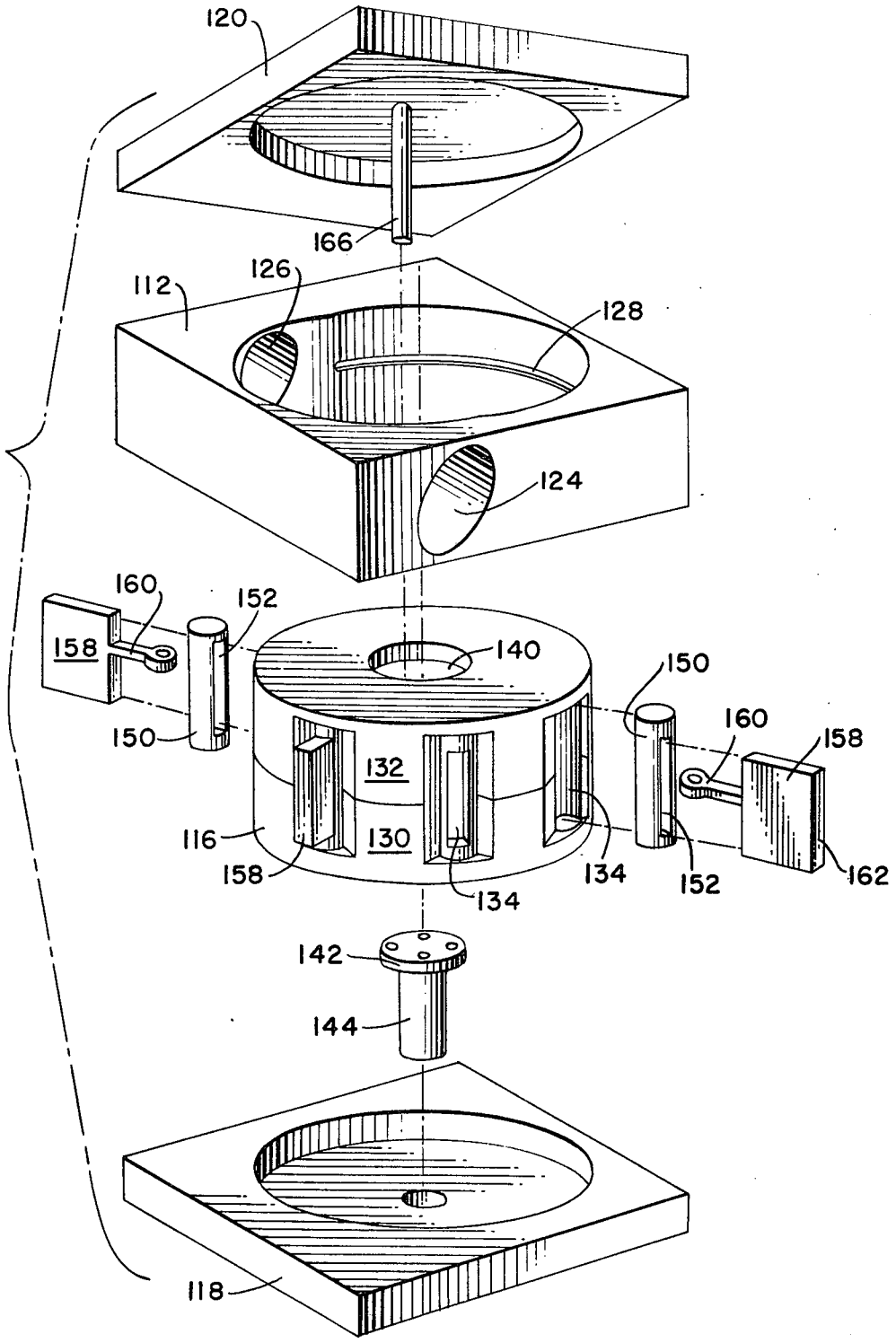
FIG. 6 is an exploded view in perspective of the embodiment of FIGS. 4 and 5.

Looking now in detail at FIGS. 4–6, it is seen that the alternative embodiment of the vane rotary device 110 according to the present invention comprises a housing member 112 with a cavity 114 extending therethrough, a rotor 116 disposed in the cavity 114 and end closure members 118, 120. Cavity 114 is generally cylindrical, but includes a cylindrical channel 122 offset radially beyond the outline of the major portion thereof which is cylindrical, of the same radius as the major portion of the cavity 114, but having its center on the axis of journal element 166. Housing member 112 is also formed with an inlet passage 124 which communicates with channel 122 at one side thereof and an outlet passage 126 which communicates with the other side thereof. Cavity 114 is further provided with a circumferentially extending groove 128, as clearly seen in FIG. 6, the function of which is similar to that described above in connection with the preferred embodiment. Rotor 116, may for convenience, be made in two separate parts 130, 132 and comprises a plurality of radial openings 134 with circumferential recesses 136, 138 on opposite sides thereof to permit slight oscillation of blades 158 thereat. For convenience, rotor 116 may be generally cylindrical in shape and provided with an enlarged aperture 140 in the part 132, as seen in FIGS. 5 and 6. Rotor 116, as seen in FIG. 5 is rigidly connected to the flange 142 of drive shaft 144 by screws 146 passing through part 130 thereof. Rotor 116 is also formed with cylindrical socket portions 148 to rotatably support cylindrical pins 150 extending axially therein with freedom to oscillate therein. Pins 150 are provided with radial openings 152. Each radial opening 152 accommodates a generally rectangular blade 158 in sliding relationship therein and constrained to rotate along with rotor 116. Each blade 158 includes a radially inwardly connecting link 160. Connecting link 160 of each blade 158, as seen in FIG. 5, is axially offset from each other and pivotally connected to journal element 166 extending inwardly from end closure member 120 in cantilever fashion. Journal element 166 further extends parallel to but eccentrically of drive shaft 144 and through and clear of enlarged aperture 140. Radially outer ends 162 of each of the blades 158 may be of generally cylindrical shape and adapted to engage with channel 122 in sealing relationship therewith.

In operation of the alternative embodiment of the rotary vane device 110, power transmission means shown in outline form on the end of drive shaft 144 effects rotation of rotor 116 whereby blades 158 are caused to move past inlet passage 124 and through channel 122 which forms a pumping chamber to pump fluid to outlet passage 126. In thus being driven clockwise, as indicated by the arrows in FIG. 4, blades 158 are caused to slide outwardly of radial openings 152 in pins 150 and radial openings 134 of rotor 116 by reason that journal element 166 is eccentric to drive shaft 144 in the direction toward channel 122 whereby the sealing members 164 are constrained to engage channel 122 in sealing relationship therewith. After the blades 158 pass the outlet passage 126, they are retracted radially inwardly of rotor 116 and in so being retracted difficulty may be expected to be encountered due to the virtual impossibility to draw a vacuum as described above in the preferred embodiment. Similarly to offset this difficulty circumferential groove 128 permits communication between radial openings 134 simultaneously moving through an idle phase of the operation so that pressure whether negative or positive in these openings 134 may be relieved therebetween. Moreover, outer ends 162 of each blade may be slightly rounded, in which case channel 122 must be similarly rounded in order to maintain the sealing relationship therebetween.

It will be obvious to those skilled in the art that various changes may be made without departing from the scope of the invention and the invention is not to be considered limited to what is shown in the drawings and described in the specification.

What is claimed is:

1. A vane rotary device comprising a housing member having a cavity extending therethrough, first and second end closure members, a rotor disposed in said cavity and rotatably supported in said housing member, said rotor having a plurality of radial openings therein, vane means disposed in each of said radial openings for sliding movement therein and rotary movement along with said rotor, an inlet passage and an outlet passage on spaced apart portions of said housing member communicating with said cavity, said cavity including a generally cylindrical circumferential portion and a channel offset radially beyond said generally cylindrical portion and extending from said inlet passage to said outlet passage, said channel in operation of said pump serving as a fluid pumping chamber, said vane means being supported on a fixed journal element concentric with said channel for pivotal movement thereabout and extending radially outwardly of said rotor and in pressure sealing relationship with said channel while being rotated through said channel by said rotor thereby pumping fluid from said inlet passage to said outlet passage, said cylindrical portion extending between said outlet passage and said inlet passage, said vane means being retracted within said rotor as said rotor passes said cylindrical portion and a circumferential groove extending in said cylindrical portion providing communication between radial openings simultaneously passing said cylindrical portion to relieve pressure therein and thereby to facilitate radial movement of said vane means.

2. The device as claimed in claim 1, wherein said vane means comprise a plurality of sliding plunger members and said rotor is rigidly connected to driving means for rotation about a second axis parallel to, but eccentric to the first axis.

3. The device as claimed in claim 2, wherein said rotor is formed with a circumferential recess radially outwardly of each of said openings on both sides of each of said plunger members to permit oscillation thereof.

4. The device as claimed in claim 3, wherein each of said radial openings is formed in an axially extending pin with said pin being pivotally supported in said rotor and each of said plunger members extending in slideable relationship in one of said pins.

5. The device as claimed in claim 4, wherein said journal element extends inwardly from one of said end closure members in cantilever fashion.

6. The device as claimed in claim 5, wherein each of said plunger members includes a radially inwardly extending connecting link portion pivotally connected to said journal element.

7. The device as claimed in claim 6, wherein each of said plunger members is generally cylindrical with a dome-shaped radially outwardly end.

8. The device as claimed in claim 7, wherein each of said plunger members is provided with a sealing member over said dome-shaped end, said sealing member being adapted to engage said circumferential channel in pumping fluid therethrough.

9. The device as claimed in claim 1, wherein said vane means comprise a plurality of sliding blade members and said rotor is rigidly connected to driving means for rotation about a second axis parallel to, but eccentric to said first axis.

10. The device as claimed in claim 9, wherein said rotor is formed with a circumferential recess radially outwardly of each of said openings on both sides of each of said blade members to permit oscillation thereof.

11. The device as claimed in claim 10, wherein each of said radial openings is formed in an axially extending pin with said pin being pivotally supported in said rotor and each of said blade members extending in slideable relationship in one of said pins.

12. The device as claimed in claim 11, wherein said journal element extends inwardly from one of said end closure members in cantilever fashion.

13. The device as claimed in claim 12, wherein each of said blade members includes a radially inwardly extending connecting link portion pivotally connected to said journal element.

14. The device as claimed in claim 13, wherein each of said blade members is generally rectangular.

15. The device as claimed in claim 14, wherein each of said blade members engages said circumferential channel with its radially outward end in sealing relationship therewith in pumping fluid therethrough.

* * * * *